US006803897B2

(12) United States Patent
Smith et al.

(10) Patent No.: US 6,803,897 B2
(45) Date of Patent: Oct. 12, 2004

(54) DISPLAY DEVICE WITH FREELY PROGRAMMABLE MULTIPLEX RATE

(75) Inventors: Adam Jonathon Smith, Zürich (CH); Marko Radovic, Zürich (CH)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 10/204,066

(22) PCT Filed: Dec. 18, 2001

(86) PCT No.: PCT/IB01/02651

§ 371 (c)(1),
(2), (4) Date: Aug. 16, 2002

(87) PCT Pub. No.: WO02/052536

PCT Pub. Date: Jul. 4, 2002

(65) Prior Publication Data

US 2003/0112214 A1 Jun. 19, 2003

(30) Foreign Application Priority Data

Dec. 22, 2000 (EP) ..... 00128445

(51) Int. Cl.[7] ..... G09G 3/36
(52) U.S. Cl. ..... 345/98; 345/100; 345/103
(58) Field of Search ..... 345/55, 59, 87, 345/98, 100, 103, 204, 211

(56) References Cited

U.S. PATENT DOCUMENTS 5,021,775 A * 6/1991 Babin
5,189,406 A * 2/1993 Humphries et al.
5,726,679 A 3/1998 Kanno et al. ..... 345/100
5,805,121 A 9/1998 Burgan et al. ..... 345/51
6,023,256 A * 2/2000 Ng et al.
6,057,824 A * 5/2000 Katakura et al.
6,084,563 A * 7/2000 Ito et al.
6,137,466 A * 10/2000 Moughanni et al.

FOREIGN PATENT DOCUMENTS

EP 0573822 A1 12/1993 ..... G09G/3/36
EP 0844600 6/1998 ..... G09G/3/36
EP 1156469 A2 11/2001 ..... G09G/3/36

* cited by examiner

*Primary Examiner*—Regina Liang
(74) *Attorney, Agent, or Firm*—Kevin Simons

(57) ABSTRACT

The invention describes a display device for displaying information, comprising a display unit 1 with a plurality of columns C and rows R and a display driver 2. Further the invention describes a display driver 2 controlling a display unit 1 with storing means 3 for providing image information to the columns C of a display. The invention relates also to a terminal for mobile communication with a display device, having a display unit 1 and a display driver 2. To achieve a flexible multiplex rate of the display a control device 4 is arranged to switch off a definable number of rows R of the display depending on a state signal which contains the state information of the rows R. By this the multiplex rate is freely programmable, so in a partial mode ($N/\bar{P}=0$) the multiplex rate is reduced and by this the power consumption is reduced. Further it is possible to enable the rows or the groups of rows in a none consecutive order.

10 Claims, 3 Drawing Sheets

DISPLAY DEVICE WITH FREELY PROGRAMMABLE MULTIPLEX RATE

Figure 1:
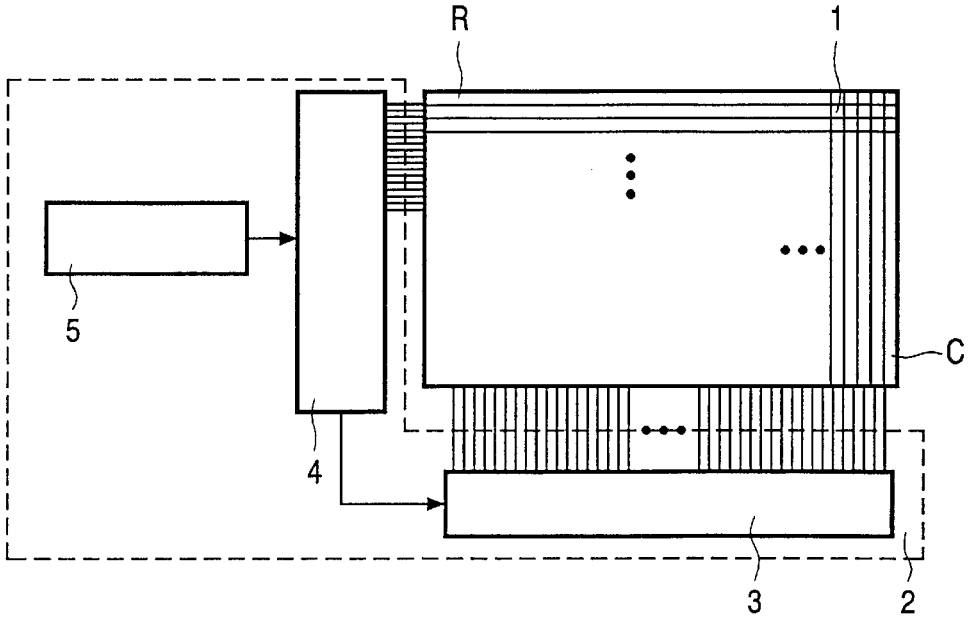

The invention describes a display device for displaying information, comprising a display unit with a plurality of columns and rows and a display driver. Further the invention describes a display driver controlling a display with storing means for providing image information to the columns of a display. The invention relates also to a terminal for mobile communication with a display device, having a display unit and a display driver.

Liquid crystal displays (LCD) are commonly used in portable computer systems, televisions and other electronic devices. LCDs have become especially popular in portable computer applications because they are sufficiently rugged and require little space to operate. Notably in applications in display devices built into portable apparatuses like mobile telephones and Personal Digital Assistants PDAs is the aim to drive these apparatuses with a minimal energy.

Since passive matrix type liquid-crystal display devices need no costly switching elements and are less expensive than active matrix liquid crystal display devices, the passive matrix type liquid crystal display devices find widespread use as monitors of portable computers and portable electronic apparatuses.

Passive matrix displays of this type are generally known and often used and, to be able to realize driving of a large number of rows, they are more and more based on the STN (Super Twisted Nematic) effect.

Many applications for LCD drivers are battery operated, most being mobile phones. Battery lifetime is one of the key market drivers for such phones. If the current consumption of such a device can be reduced then the standby time can be increased. Alternately, the battery capacity may be reduced giving a reduction in weight, another key factor. Turning the display off during standby mode is the best way to save power, however this means the user will not know if the devices is functioning or not functioning, some information must still be made available to the user. So it is required to be able to activate part of the display to show some useful information, e.g. the network provider or the time. Using part of the display is a compromise between having the display completely on or off.

The multiplex rate has a strong effect on the current consumption. LCD driver circuits use a multiplex method for driving large numbers of segment e.g. 64 rows by 100 columns, giving control over 6400 pixels. Simply the display works by selecting a row and then presenting the column data associated with that row on the column outputs. The display driver circuit then moves onto the next row and the next set of column data. This has to be repeated at sufficient rate so as not to generate flickering on the display. The number of rows driven defines the multiplex rate. When every row has been driven once, a frame is said to have taken place. Each row is only active once per frame and hence the average voltage across any one pixel $V_{RMS}$ is proportional to the multiplex rate. The higher the multiplex rate the lower the average voltage on the pixel. To compensate for the low average voltage, the supply voltage $V_{OP}$ applied to the pixel is raised. The supply voltage is generated from a DC-DC converter. Every micro-amp taken from $V_{OP}$ is reflected down to the supply voltage $V_{DD}$ with a multiplication factor equivalent to the number of stages in the DC-DC converter. Reducing the display supply voltage can make a huge current saving. When the multiplex rate is reduced, the $V_{OP}$ is reduced, and ultimately the current $I_{DD}$ is reduced also. So roughly if the number of stages is halved, the supply current $I_{DD}$ for display device will be halved.

The EP 0 844 600 A1 describes a liquid crystal display device (LCD) having a first display portion and a second display portion in the same panel, in addition to a normal operation mode in which both of the display portions are driven there is also provided a power-save operation mode in which only the second display portion is driven. In the power-save operation mode, the duty ratios of the display portions in the power-save operation mode are lower than those in the normal operation mode and time shared drive wave-forms are applied using an unchanged power source voltage, which does not require a bias voltage. A liquid crystal device having reduced power consumption is thus provided.

In current display devices with the possibility of a reduced active display area, the active area is hard coded into the silicon chip. This allows only the use of the certain number of rows i.e. on the top or on the bottom of the display. This is a severe limitation to the end user since it would be nice to have the possibility to display the network provider across the center of the display and perhaps some icon information along the bottom. It is possible in hardware to select any group of rows for 'partial display' operation, but this is then fixed for the driver circuit and unsuitable as a universal LCD driver.

It is therefore an object of the invention to provide a display device and a display driver of the type described above in which the necessary drive voltage and the power consumption is as small as possible in conjunction with a freely programmable multiplex rate.

This is achieved by the display device to the claim 1 and the display driver to the claim 10.

Thus, it is possible to change the multiplex rate and the display area freely.

An advantage of the invention is the strongly decreased power consumption if the multiplex rate is lower.

Figure 2:
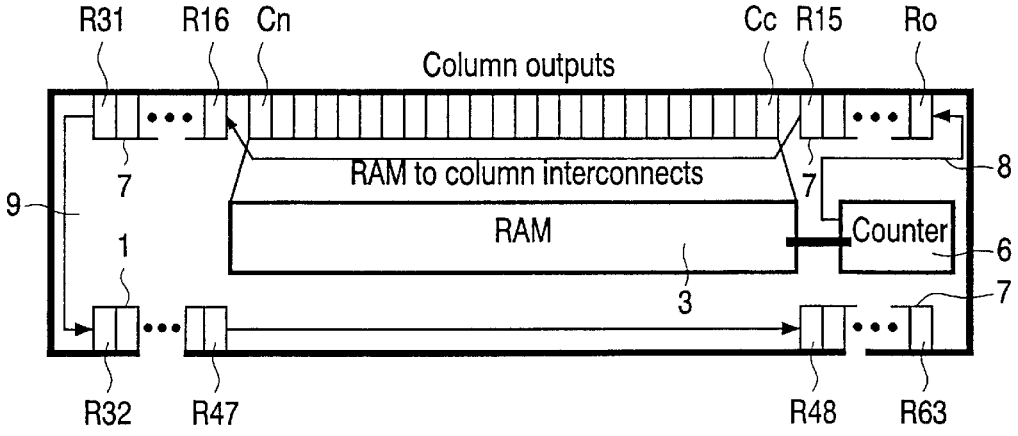

A better understanding of the present invention can be obtained when following detailed description of the preferred embodiment is considered in conjunction with the following drawings, in which:

FIG. 1 shows a block diagram of the display device with the display unit and the display driver circuit FIG. 2 detailed block diagram of the display driver 3

Figure 3:
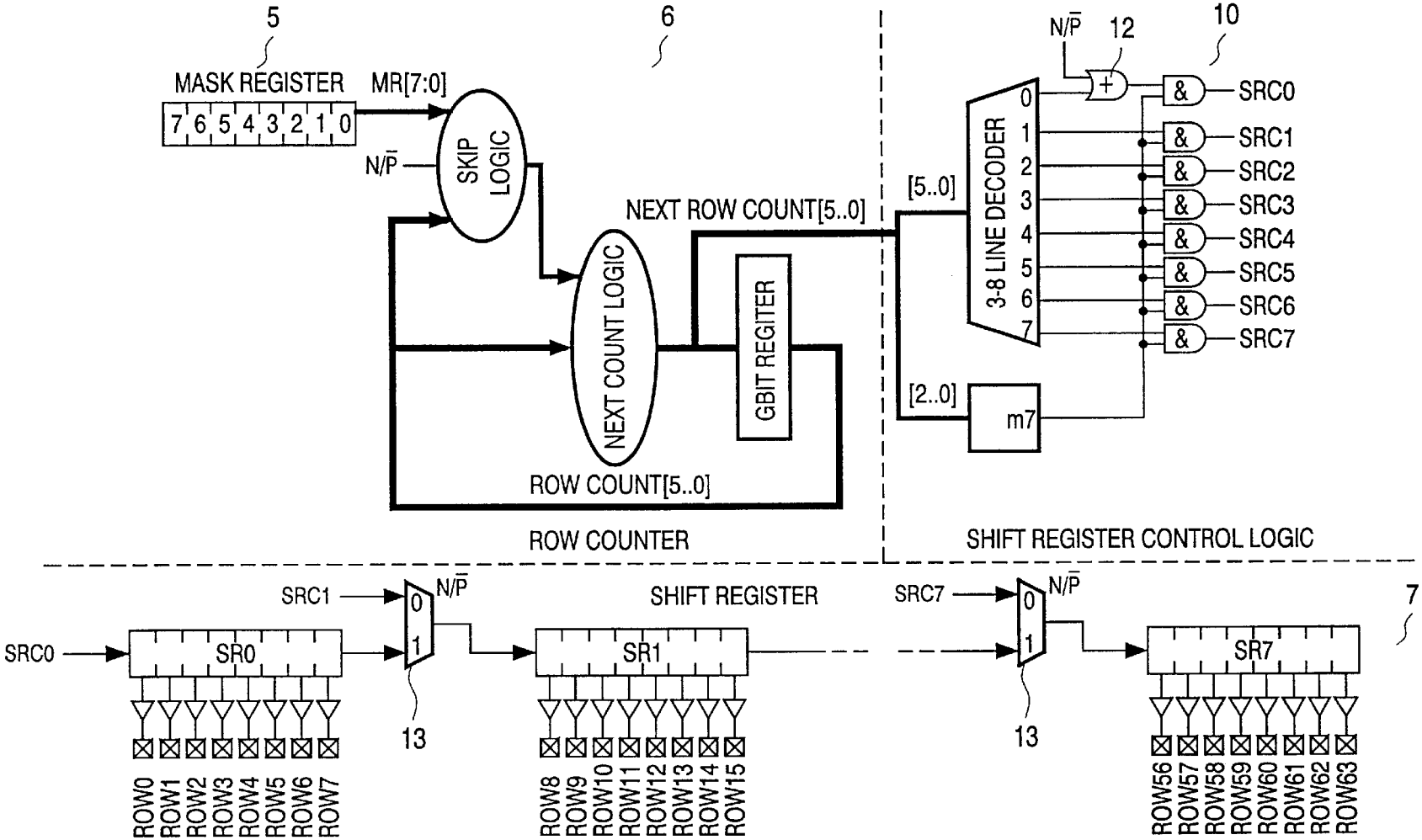

FIG. 3 detailed block diagram of the control device 4 with the mask register 5

Figure 4:
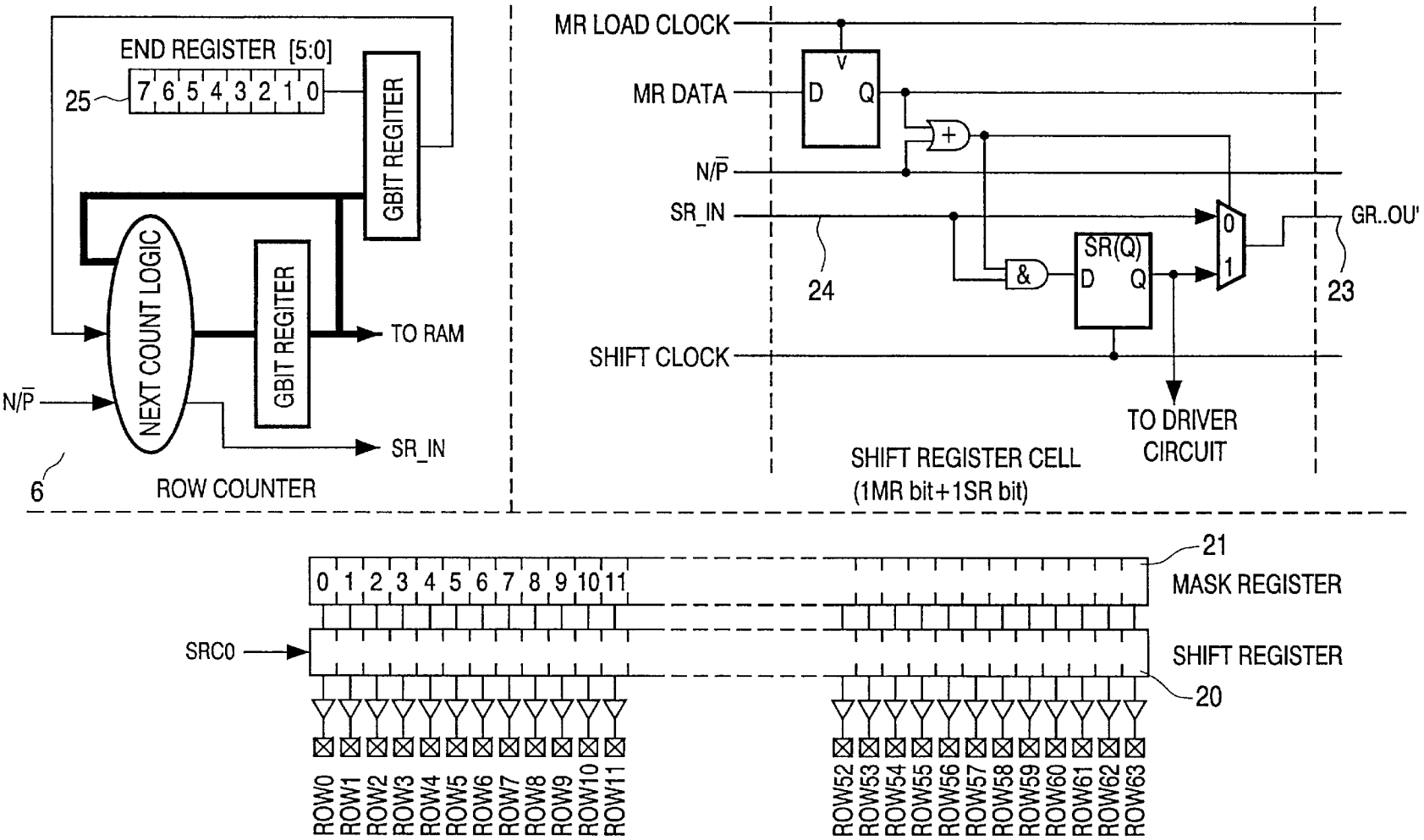

FIG. 4 detailed block diagram for a fully flexible row selection

The display device comprises a display unit 1 with a plurality of columns C and rows R, and a display driver circuit 2 containing storing means 3, realized as a RAM 3, for storing the image information or image data which have to be displayed, and a control device 4 and a state register realized as mask register 5.

One of the key methods for reducing chip area and power consumption is by not having a signal from each LCD pad (both rows and columns) to the control device 4.

This is achieved as follows: The column data comes directly from the RAM 3, hence the column outputs are placed directly beneath the RAM 3. The RAM 3 output data according to which row is currently active. This is achieved by the use of a row counter 6 that is allocated in the control device 4. The output of the row counter 6 is fed into the RAM 3. The RAM 3 then decodes the row counter 6 and outputs the appropriate data. When the row counter 6 reaches the maximum count, which stands for the number of rows to be driven, it rolls over to 0. e.g. for a MUX 62:1 system the row counter counts 0 to 61.

For the display to work, the correct row R must be active at the same time as the respective column data is output to the column outputs $C_0$–$C_n$. Decoding the row counter 6 output and sending a signal to each row pad $R_0$ to $R_{63}$ would imply a huge routing overhead. Since it is known that the next row always follows the last, a simple shift register 7 is used therefore. This shift register 7 is subdivided in different parts allocated in the control device 4. Each time the row counter 6 rolls over, a one is input into the start $R_0$ of the shift register 7. Each time the row counter 6 is incremented the shift register 7 is shifted. This requires only one signal 8 from the row counter 6 to the row pad $R_0$. Typically for easy of display glass layout the row pads $R_0$ to $R_{63}$ are distributed around the die 9.

Text characters to be displayed are normally constructed in a five by seven dot-matrix array, and often include an eighth row for an underscore. With this in mind it is possible to limit the row selection to groups of eight. Any or all of these groups of rows (block) may be enabled or selected. To make the selection, a suitable sized mask register is required, which stores one bit as a state per group of eight rows (block). The single shift register 7 described above must be split into eight bit sections. Each block or groups of rows is decoded in the mask register. The signal for decoding the respective group of rows is provided from a core logic, which is i.e. the base band controller of a mobile terminal. The core logic defines the different types of display mode. In a full size display mode or normal mode all bits of the mask register 5 will be programmed to display all blocks of rows. In a partial mode, whereas only a few rows are necessary to be displayed some blocks of the mask register are enabled and the not necessary blocks are disabled.

The row counter 6 is in turn controlled by the mask register 5. The mask register 5 causes the row counter 6 to count eight bits, then jumps to the next enabled eight-bit group. E.g. If the first eight rows and the third eight rows are selected then the row counter will count 0 . . . 7, 16 . . . 23 . . . The count of 8 . . . 15 has been skipped. Since the row counter 6 has jumped eight bits, the shift register 7 must do the same. This is achieved by the previously mentioned control signals from the core logic. In this example the first shift register is activated by pushing a one into it. After eight shifts, the third shift register is activated in the same way. This concept can be expanded to suite other groups sizes e.g. 16, 8, 4, 2, 1. The limiting factor is the requirement of the decoder, which decodes the control signals. If the groups of rows are of size 1, then a control line must be routed from the logic block to each row pad. This represents a large overhead in area.

FIG. 3 is an example circuit describing the system for a 64-row driver. The decode logic is described in function but for clarity the actual gates are not shown. The logic may be broken down into four logical parts:

1. Mask register
2. Shift register
3. Shift register control logic
4. Row counter The mask register 5 is programmed by the user to define, which rows are active and which are not, whereby one bit per eight rows is necessary. A logic 1 implies the group of rows is on and enabled.

TABLE 1 shows the content of a mask register

| MR[7 . . . 0] | Active rows | Group |
|---|---|---|
| [0] | 0 . . . 7 | SR0 |
| [1] | 8 . . . 15 | SR1 |
| [2] | 16 . . . 23 | SR2 |
| [3] | 24 . . . 31 | SR3 |
| [4] | 32 . . . 39 | SR4 |
| [5] | 40 . . . 47 | SR5 |
| [6] | 48 . . . 55 | SR6 |
| [7] | 55 . . . 63 | SR7 |

The shift register (SR) activates the row output driver. Normally the SR is filled entirely with zero's bar a single 1. A 1 in the SR indicates the associated output is active. Only one 1 should exist in the SR at any given time. In Normal mode, a 1 is input into SR0 and allowed to flow all the way through to the end. In Partial mode this flow is broken by the multiplexers 13.

A 1 is input only into the shift register of the active groups. After eight shifts the output from that group is ignored.

The shift register control logic 10 decodes the row counter 6 and determines which group of row drivers will be active next. The SR control logic 10 provides a 1 for the input of the respective shift register SR0 to SR7. A 1 is only generated for a single clock period, else more than one 1 would exist in the shift register at any given time. This function is generated by the '=7' detector 11.

In normal mode a 1 is always input into SR0 at the start of a frame. This is the function of the OR gate 12, it effectively overrides the contents of MR[0].

In partial mode ($N/\overline{P}=0$), a 1 is generated in the same way except that the row counter 6 is jumping around. If the mask register 5 is filled with all 1's then this will have the same effect as entering normal mode.

When in normal mode ($N/\overline{P}=1$), the row counter 6 counts in normal binary format from 0 to 63. When in partial mode ($N/\overline{P}=0$), The count sequence is determined by the state of the mask register 5. The row counter can effectively be split in two; a three bit counter for the lsb's and a three bit counter for the msb's. The lsb counter will operate as a standard binary counter, continuously counting 0 . . . 7. The msb counter always counts up but is steered by the mask register. The mask register 5 may cause the row counter to skip certain values. The intention is make the row counter 5 only count through the rows which are active.

TABLE 2 shows an example

| MR | MR value | Row counter Count sequence | Active groups |
|---|---|---|---|
| [0] | 1 | 0 . . . 7 | SR0 |
| [1] | 0 | | |
| [2] | 0 | | |
| [3] | 1 | 24 . . . 31 | SR3 |
| [4] | 0 | | |
| [5] | 0 | | |
| [6] | 0 | | |
| [7] | 1 | 56 . . . 63 | SR7 |

The row counter 6 is also output to the storing mean or RAM 3. In this case only the RAM 3 content associated with the active row are displayed.

TABLE 3 example display Normal Mode ($N/\overline{P} = 1$)

| MR | MR value | Active groups | Row counter Count sequence | Normal display |
|---|---|---|---|---|
| [0] | 1 | SR0 | 0 . . . 7 | Battery status: yy |
| [1] | 1 | SR1 | 8 . . . 15 | Address book |
| [2] | 1 | SR2 | 16 . . . 23 | Connection time |
| [3] | 1 | SR3 | 24 . . . 31 | Network XXX |
| [4] | 1 | SR4 | 32 . . . 39 | Reception strength |
| [5] | 1 | SR5 | 40 . . . 47 | Date, time |
| [6] | 1 | SR6 | 48 . . . 55 | Call mode |
| [7] | 1 | SR7 | 56 . . . 63 | Keyboard locked |

TABLE 4 example display partial mode ($N/\overline{P} = 0$)

| MR | MR value | Active groups | Row counter Count sequence | Normal display |
|---|---|---|---|---|
| [0] | 1 | SR0 | 0 . . . 7 | Battery status: yy |
| [1] | 0 | | | |
| [2] | 0 | | | |
| [3] | 1 | SR3 | 24 . . . 31 | Network XXX |
| [4] | 0 | | | |
| [5] | 0 | | | |
| [6] | 0 | | | |
| [7] | 1 | SR7 | 56 . . . 63 | Keyboard locked |

As a second solution of the invention a fully flexible row selection will be described.

A shift register 20 is used to enable the row drivers one at a time. If that shift register 20 could be made to skip certain rows then it would be possible to control, which rows are on and which are off. In order to achieve this a mask register 21 of the same length as the shift register 20 is used. If the row counter 6 is then limited to a count of equal length as the number of active rows then the display can work with fully flexible row selection, whereas the multiplex rate is dependent of the selected number of rows only. With this system there is no data flow between the row counter and the shift register 20, therefore it is necessary for the data to be displayed to be moved to the 'front' of the RAM 3. It would also be possible to have a special RAM 3*a* area for partial mode, however this would constitute a considerable increase in silicon area. If taken to the limit it would require a second RAM of equal size.

FIG. 4 is an example circuit describing the system for a 64 row driver. The logic may be broken down into three logical parts:

1. Mask register 21
2. Shift register cell 22
3. Row counter 6

The mask register 21 is used to determine which row is on and which one is off. When in normal mode the mask register 6 output will be overridden. The mask register 21 is itself a shift register and is loaded serially. Under normal circumstances the entire mask register 21 would need to be updated in one go. The mask register 21 should not be updated whilst in partial mode.

The shift register 20 is adapted to make its output 23 controlled by the mask register 21. If the row is disabled the output 23 is the source from the previous cells input. If the row is enabled the output 23 comes from this cells own shift register. By this method a row may be by-passed. If a row is disabled then the shift register input 24 must always be a zero. If the row is enabled then the shift register input 24 is the previous rows output. The steering of the input 24 and output 23 is controlled by the mask register 21.

TABLE 5 shows a Shift register cell I/O, Partial mode ($N/\overline{P} = 0$)

| MR[n] | SR_IN[n] | SR_OUT[n] |
|---|---|---|
| 0 | 0 | SR_IN[n − 1] |
| 1 | SR_OUT[n − 1] | SR[n] |

TABLE 6 shows a shift register cell I/O in normal Mode ($N/\overline{P} = 1$)

| MR[n] | SR_IN[n] | SR_OUT[n] |
|---|---|---|
| X | SR_OUT[n − 1] | SR[n] |

The row counter 6 is modified to end its count at a programmed value. Normally it would be allowed to continue until the maximum count is reached and then roll over. In partial mode the counter must only count to the equivalent number of active rows. e.g. if 10 rows are active then the counter must count 0 to 9. Each time the counter rolls over, either naturally or because the end count has been reached, a 1 is input into the shift register 20. Because there is no feed back from the mask register 21 the user must program the end register 25. Since the count always starts at zero the end register 25 must be programmed to one less than the number of active rows.

The row counter is also output to the RAM 3. Since the row counter 6 always starts at zero, any display data or image data must also start at zero. This means that in the RAM 3, the display data for partial mode will be contiguous, starting from RAM location zero (see table 9).

TABLE 7 shows a display example in partial mode ($N/\overline{P} = 0$)

| n | MR [n] | | |

TABLE 7-continued shows a display example in partial mode ($N/\overline{P} = 0$)

| n | MR [n] | | | | | | | | | | | | | | | | | | | | | | | | Row counter |
|---|---|---|---|---|---|---|---|---|---|---|---|---|---|---|---|---|---|---|---|---|---|---|---|---|---|
| 5 | 1 | • | | • | | • | | • | • | • | | | | | • | | | | | | | • | | | 3 |
| 6 | 1 | • | | • | | • | | • | | | | | | | • | | | | | | • | | • | | 4 |
| 7 | 1 | • | | | • | • | | • | | | | | | | • | | | | • | | | | | • | 5 |
| 8 | 1 | • | | | | • | | • | • | • | • | | | | • | | | | • | | | | | • | 6 |
| 9 | 0 | | | | | | | | | | | | | | | | | | | | | | | | |
| 10 | 0 | | | | | | | | | | | | | | | | | | | | | | | | |
| 11 | 1 | • | • | • | • | • | • | • | • | • | • | • | • | • | • | • | • | • | • | • | • | • | • | • | 7 |
| 12 | 0 | | | | | | | | | | | | | | | | | | | | | | | | |
| . | | | | | | | | | | | | | | | | | | | | | | | | | |
| . | | | | | | | | | | | | | | | | | | | | | | | | | |
| . | | | | | | | | | | | | | | | | | | | | | | | | | |
| 62 | 0 | | | | | | | | | | | | | | | | | | | | | | | | |
| 63 | 0 | | | | | | | | | | | | | | | | | | | | | | | | |

TABLE 8 shows the RAM content in Partial mode ($N/\overline{P} = 0$)

| RAM location | | | | | | | | | | | | | | | | | | | | | | | | |
|---|---|---|---|---|---|---|---|---|---|---|---|---|---|---|---|---|---|---|---|---|---|---|---|---|
| 0 | | • | | | | • | | • | • | • | • | | • | • | • | • | • | | • | | | | • | |
| 1 | | • | • | | | • | | • | | | | | | | • | | | | • | | | | • | |
| 2 | | • | | • | | • | | • | | | | | | | • | | | | | • | | • | | |
| 3 | | • | | • | | • | | • | • | • | | | | | • | | | | | | • | | | |
| 4 | | • | | • | | • | | • | | | | | | | • | | | | | • | | • | | |
| 5 | | • | | | • | • | | • | | | | | | | • | | | | • | | | | • | |
| 6 | | • | | | | • | | • | • | • | • | | | | • | | | | • | | | | • | |
| 7 | | • | • | • | • | • | • | • | • | • | • | • | • | • | • | • | • | • | • | • | • | • | • | • |
| 8 | X | X | X | X | X | X | X | X | X | X | X | X | X | X | X | X | X | X | X | X | X | X | X | X |
| . | | | | | | | | | | | | | | | | | | | | | | | | |
| . | | | | | | | | | | | | | | | | | | | | | | | | |
| . | | | | | | | | | | | | | | | | | | | | | | | | |
| 62 | X | X | X | X | X | X | X | X | X | X | X | X | X | X | X | X | X | X | X | X | X | X | X | X |
| 63 | X | X | X | X | X | X | X | X | X | X | X | X | X | X | X | X | X | X | X | X | X | X | X | X |

X = Contents do not matter since they are not displayed

TABLE 9 shows an example in Normal mode ($N/\overline{P} = 1$)

| N | MR [n] | | | | | | | | | | | | | | | | | | | | | | | | Row counter |
|---|---|---|---|---|---|---|---|---|---|---|---|---|---|---|---|---|---|---|---|---|---|---|---|---|---|
| 0 | 1 | | | | | | | | | | | | | | | | | | | | | | | | 0 |
| 1 | 1 | | | | | | | | | | | | | | | | | | | | | | | | 1 |
| 2 | 1 | • | | | | • | | • | • | • | • | | • | • | • | • | • | | • | | | | | • | 2 |
| 3 | 1 | • | • | | | • | | • | | | | | | | • | | | | • | | | | | • | 3 |
| 4 | 1 | • | | • | | • | | • | | | | | | | • | | | | | | • | | • | | 4 |
| 5 | 1 | • | | • | | • | | • | • | • | | | | | • | | | | | | | • | | | 5 |
| 6 | 1 | • | | • | | • | | • | | | | | | | • | | | | | | • | | • | | 6 |
| 7 | 1 | • | | | • | • | | • | | | | | | | • | | | | • | | | | | • | 7 |
| 8 | 1 | • | | | | • | | • | • | • | • | | | | • | | | | • | | | | | • | 8 |
| 9 | 1 | | | | | | | | | | | | | | | | | | | | | | | | 9 |
| 10 | 1 | | | | | | | | | | | | | | | | | | | | | | | | 10 |
| 11 | 1 | • | • | • | • | • | • | • | • | • | • | • | • | • | • | • | • | • | • | • | • | • | • | • | 11 |
| 12 | 1 | | | | | | | | | | | | | | | | | | | | | | | | 12 |
| . | | | | | | | | | | | | | | | | | | | | | | | | | . |
| . | | | | | | | | | | | | | | | | | | | | | | | | | . |
| . | | | | | | | | | | | | | | | | | | | | | | | | | . |
| 62 | 1 | | | | | | | | | | | | | | | | | | | | | | | | 62 |
| 63 | 1 | | | | | | | | | | | | | | | | | | | | | | | | 63 |

TABLE 10 shows the RAM content in Normal mode ($N/\overline{P} = 1$)

| RAM location | | | | | | | | | | | | | | | | | | | | | | | |
|---|---|---|---|---|---|---|---|---|---|---|---|---|---|---|---|---|---|---|---|---|---|---|---|
| 0 | | | | | | | | | | | | | | | | | | | | | | | |
| 1 | | | | | | | | | | | | | | | | | | | | | | | |
| 2 | • | | | | • | | • | • | • | • | | • | • | • | • | • | | • | | | | | • |
| 3 | • | • | | | • | | • | | | | | | | • | | | | • | | | | | • |
| 4 | • | | • | | • | | • | | | | | | | • | | | | | | • | | • | |
| 5 | • | | • | | • | | • | • | • | | | | | • | | | | | | | • | | |
| 6 | • | | • | | • | | • | | | | | | | • | | | | | | • | | • | |
| 7 | • | | | • | • | | • | | | | | | | • | | | | • | | | | | • |
| 8 | • | | | | • | | • | • | • | • | | | | • | | | | • | | | | | • |
| 9 | | | | | | | | | | | | | | | | | | | | | | | |
| 10 | | | | | | | | | | | | | | | | | | | | | | | |
| 11 | • | • | • | • | • | • | • | • | • | • | • | • | • | • | • | • | • | • | • | • | • | • | • |
| 12 | | | | | | | | | | | | | | | | | | | | | | | |
| . | | | | | | | | | | | | | | | | | | | | | | | |
| . | | | | | | | | | | | | | | | | | | | | | | | |
| . | | | | | | | | | | | | | | | | | | | | | | | |
| 62 | | | | | | | | | | | | | | | | | | | | | | | |
| 63 | | | | | | | | | | | | | | | | | | | | | | | |

What is claimed is:

1. A display device for displaying information, comprising:

a display unit for displaying the information, the display unit having R rows, and C columns;

an image storage memory having image information to be displayed stored therein, the image storage memory configured to supply image information to each of the C columns, and wherein, at least during a partial display mode, image information is stored contiguously therein, regardless of whether there will be blank rows displayed between any of the rows of the image information;

R driver circuits, each driver circuit coupled to a corresponding one of the R rows;

a shift register having R shift register cells, each shift register cell of the shift register having an input terminal for receiving input data, and each shift register cell of the shift register having an output terminal coupled to a corresponding one of the R driver circuits;

each shift register cell comprising:

a mask register bit;

a shift register bit;

a logic circuit, the logic circuit coupled to receive a signal from an output terminal of the mask register bit, the logic circuit further coupled to provide a signal to the shift register bits; and a by-pass multiplexer, the by-pass multiplexer having a control input terminal coupled to the logic circuit the by-pass multiplexer having a first data input terminal coupled to an output terminal of the shift register bit, and further having a second data input terminal;

wherein the mask register bit determines, at least in part, whether the corresponding driver circuit is enabled to drive the corresponding row to an active state.

2. The display device of claim 1, further comprising:

a row counter coupled to the image storage memory, and further coupled to the shift register; and an end count register, coupled to the row counter.

3. The display device of claim 2, wherein the row counter is configured to count between zero and a value specified by the end count register.

4. The display device of claim 3, further comprising a normal/partial signal source coupled to each logic circuit.

5. The display device of claim 4, wherein when the normal/partial signal indicates normal operation, each by-pass multiplexer provides as an output signal, the value presented by the shift register bit coupled thereto.

6. The display device of claim 1, further comprising a terminal for mobile communication having an input means for determining a display state signal, coupled to the display unit.

7. A method of operating a display device, comprising:

loading an end count into an end count register, wherein the end count indicates the number of rows that will be active during a state in which only a partial display is to be activated;

loading a plurality of bits into a mask register having R bits, wherein the state of each mask register bit is used to determine whether a corresponding row is to be active or inactive during the state in which only a partial display is to be activated;

loading image information into an image storage memory wherein all rows of the image information are stored contiguously, regardless of whether there will be blank rows displayed between any of the rows of image information;

retrieving image information from the image storage memory based at least in part on the state of a row counter, and providing the retrieved image information to a plurality of columns of a display unit having R rows and C columns;

setting a normal/partial signal to the state that indicates that only a partial display is to be activated;

generating a shift register input signal; and determining, based at least in part upon the state of the normal/partial signal and the bits of the mask register, whether each of a plurality of by-pass multiplexers selects the output of a corresponding shift register bit, or the shift register input signal, as the by-pass multiplexer output signal;

wherein R, and C are integers.

8. The method of claim 7, further comprising:

incrementing the row counter; and retrieving image information from the image storage memory based at least in part on the state of the row counter, and providing the retrieved image information to the plurality of columns of the display unit.

9. The method of claim 8, further comprising:

determining, based at least upon the state of the end count register and the state of the row counter, whether to reset the row counter.

10. The method of claim 9, further comprising:

setting the normal/partial signal to a state that indicates that only a display including all rows is to be activated.

* * * * *